US007959405B2

(12) United States Patent
Launders

(10) Patent No.: US 7,959,405 B2
(45) Date of Patent: Jun. 14, 2011

(54) BLADE CONTAINMENT STRUCTURE

(75) Inventor: Paul D. Launders, Nottingham (GB)

(73) Assignee: Rolls-Royce PLC, London (GB)

( * ) Notice: Subject to any disclaimer, the term of this patent is extended or adjusted under 35 U.S.C. 154(b) by 1059 days.

(21) Appl. No.: 11/410,011

(22) Filed: Apr. 25, 2006

(65) Prior Publication Data

US 2006/0260293 A1 Nov. 23, 2006

(30) Foreign Application Priority Data

May 18, 2005 (GB) ..... 0510078.9

(51) Int. Cl.
*F01D 21/00* (2006.01)

(52) U.S. Cl. ..... 415/9

(58) Field of Classification Search ..... 415/9, 173.4, 415/174.4

See application file for complete search history.

(56) References Cited

U.S. PATENT DOCUMENTS

| | | | | |
|---|---|---|---|---|
| 4,666,371 | A * | 5/1987 | Alderson | 415/9 |
| 5,516,258 | A * | 5/1996 | Newton | 415/9 |
| 6,053,696 | A | 4/2000 | Roberts | |
| 6,497,550 | B2 * | 12/2002 | Booth | 415/9 |
| 7,246,990 | B2 * | 7/2007 | Xie et al. | 415/9 |
| 2005/0089390 | A1 * | 4/2005 | Gerain et al. | 415/9 |

FOREIGN PATENT DOCUMENTS

| | | | |
|---|---|---|---|
| EP | 0 927 815 | A2 | 7/1999 |
| GB | 2 246 818 | A | 2/1992 |
| GB | 2 288 639 | A | 10/1995 |

* cited by examiner

*Primary Examiner* — Christopher Verdier
(74) *Attorney, Agent, or Firm* — Oliff & Berridge, PLC

(57) ABSTRACT

The fan duct of a ducted fan gas turbine engine has a fan case (20) lined with a honeycomb structure (22) that acts to absorb the energy of a separated part of a blade (16). A layer of composite material (24) lining honeycomb structure (22) delaminates/breaks when a separated blade part passes through a further, inner honeycomb liner (26) and hits it.

The resulting free end of composite liner (24) wraps round the striking end of the blade part, thus blunting the cutting action of the blade part and spreading the generated forces to the extent that the blade part is de-energised sufficiently to prevent it penetrating the fan case (20).

9 Claims, 3 Drawing Sheets

BLADE CONTAINMENT STRUCTURE

The present invention relates to a casing structure surrounding blades that rotate within the casing, which structure, during blade rotation, will prevent any broken off blade parts from damaging the enclosing casing.

It is known from published patent application GB 2,288,639, EP 0 927 815 A2 and others, to provide containment structure that will prevent exit of a broken blade part from a fan to atmosphere via the cowl streamlined outer surface structure. However, in each case, the inner casing structure is penetrated and results in the need to replace it.

The present invention seeks to provide an improved broken off blade part containment structure. Blade part means aerofoil portion or root portion.

According to the present invention, a separated blade part containment structure comprises a casing containing an annular metallic structure having a liner of composite material which is stronger in compression in a direction radially of the assembly than in tension in a direction peripherally thereof, so as to ensure breaking of said liner along its axial length if trapped between a separated moving blade part and said metallic annular structure, to enable a then free end of said liner to wrap around the liner contacting portion of said separated blade part.

The invention will now be described, by way of example and with reference to the accompanying drawings, in which.

Figure 1:
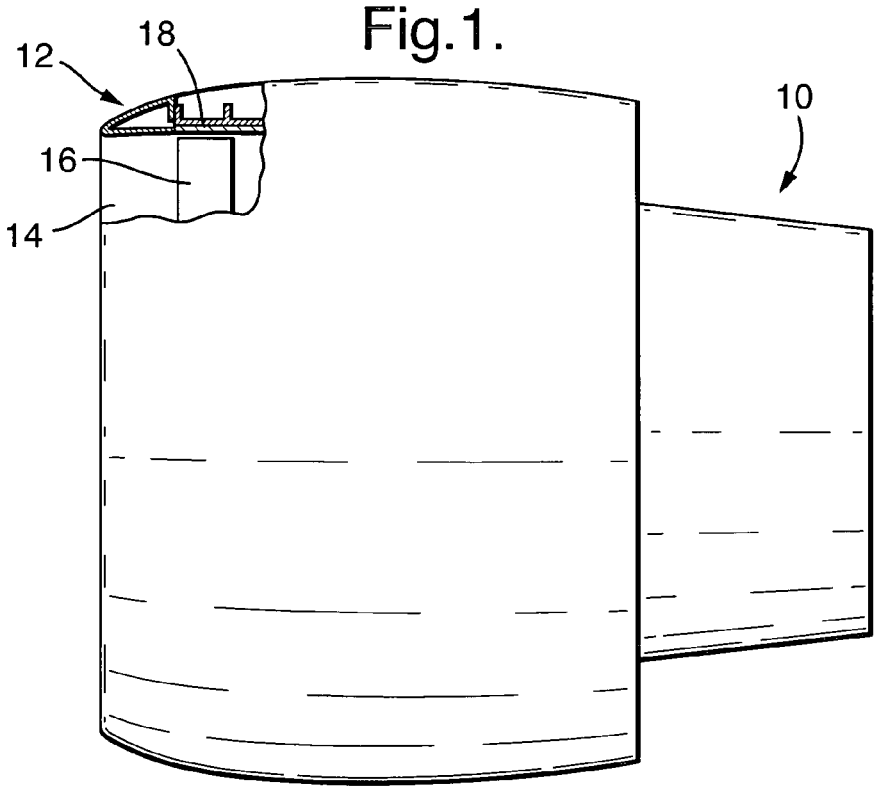
FIG. 1 is a diagrammatic representation of a ducted fan gas turbine engine.

Referring to FIG. 1. A gas turbine engine 10 has a ducted fan 12 connected thereto at its upstream end, in generally known manner. The fan duct 14 contains a single stage of blades 16, each consisting of an aerofoil and root (not shown). Only a radially outer part of one aerofoil is shown. Fan duct 14 is defined by a structure 18.

Figure 2:
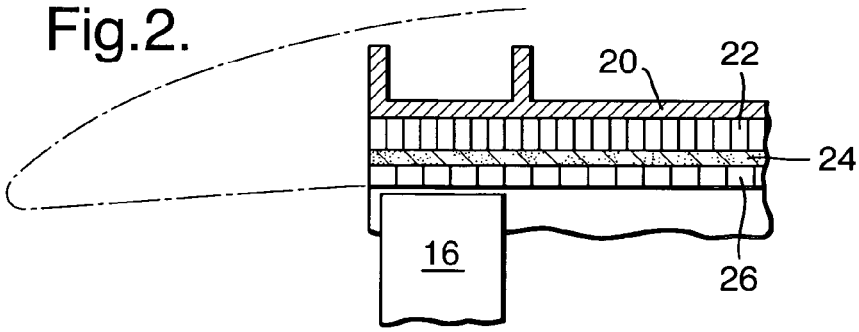
FIG. 2 is an enlarged part view of the fan duct depicted in FIG. 1, and includes the radially outer end of a fan blade prior to its separation by breaking.

Referring now to FIG. 2. Structure 18 consists of a casing 20, an annular honeycomb structure 22 bonded to the inner surface of casing 20, and an annular layer of a composite material 24 trapped between honeycomb structure 22 and a further, abradable innermost honeycomb structure 26. The annular layer of composite material 24 may be bonded to the annular honeycomb structure 22. Aerofoil 16 is again shown in appropriate positional relationship with wall structure 18, so as to enable operational rotation of the stage of blades (not shown) within duct 14.

Figure 3:
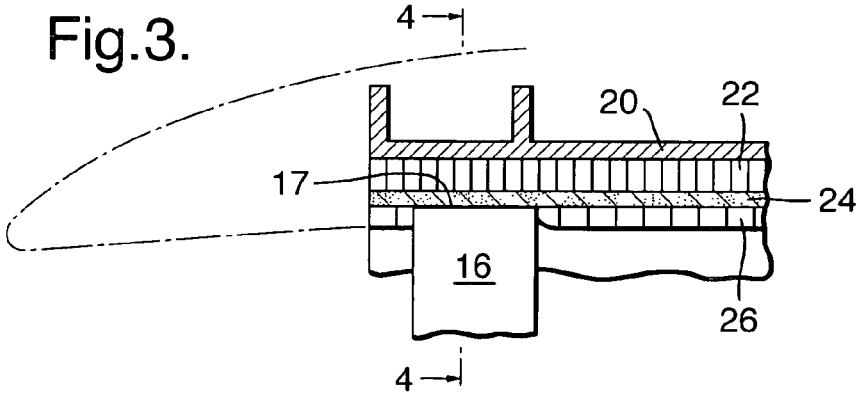
FIG. 3 is as FIG. 2 but with the fan blade broken and displaced in a direction having a radial component to the axis of rotation.

Referring now to FIG. 3. During operational rotation of the fan stage (not shown), the radially outer part of aerofoil 16 has broken from its root and associated disk (not shown), and has penetrated the full thickness of innermost honeycomb structure 26, and the aerofoil tip 17 abuts the layer of composite material 24.

Figure 4:
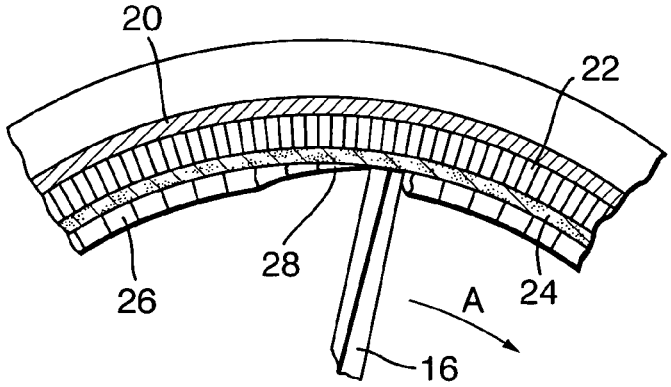
FIG. 4 is a view in the direction of arrows 4-4 in FIG. 3.

Referring now to FIG. 4. Separated aerofoil part 16 has components of movement in both radial and tangential directions in the plane of rotation of the fan stage (not shown).

Aerofoil part 16 thus carves an arcuate groove 28 in the innermost honeycomb structure 26.

Figure 5:
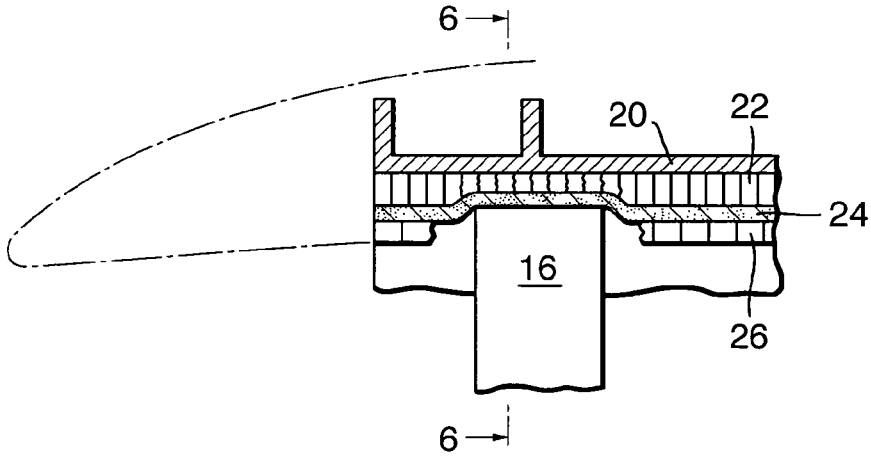
FIG. 5 is as FIG. 3 but with the fan blade displacement increased.

Referring now to FIG. 5. The radial component of movement of separated aerofoil part 16 has increased to the extent that it has forced composite layer 24 into the honeycomb structure 22, partially crushing it.

Figure 6:
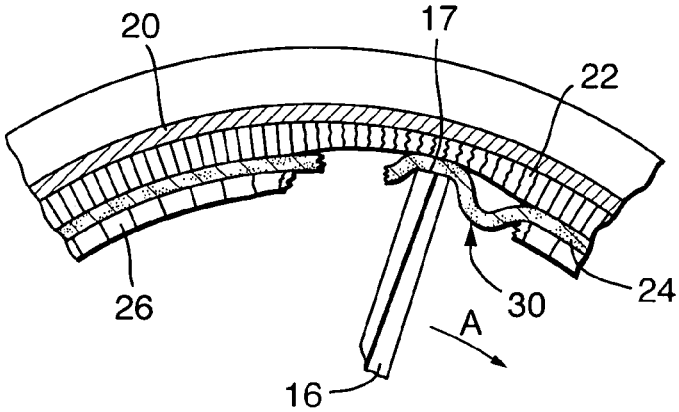
FIG. 6 is a view in the direction of arrows 6-6 in FIG. 5.

Referring now to FIG. 6. The continued clockwise (arrow A) peripheral and radial components of movement of separated aerofoil part 16 and the subsequent pressure on composite layer 24 has applied sufficient tension to the composite layer 24 to cause it to delaminate/break. The resulting composite layer end portion 30 that spans its trapped portion between the tip 17 of aerofoil part 16 and honeycomb structure 22 starts to fold around tip 17, thus acting as a buffer, which results in blunting the peripheral cutting action of aerofoil tip 17, and spreading the forces generated over a bigger area.

Figure 7:
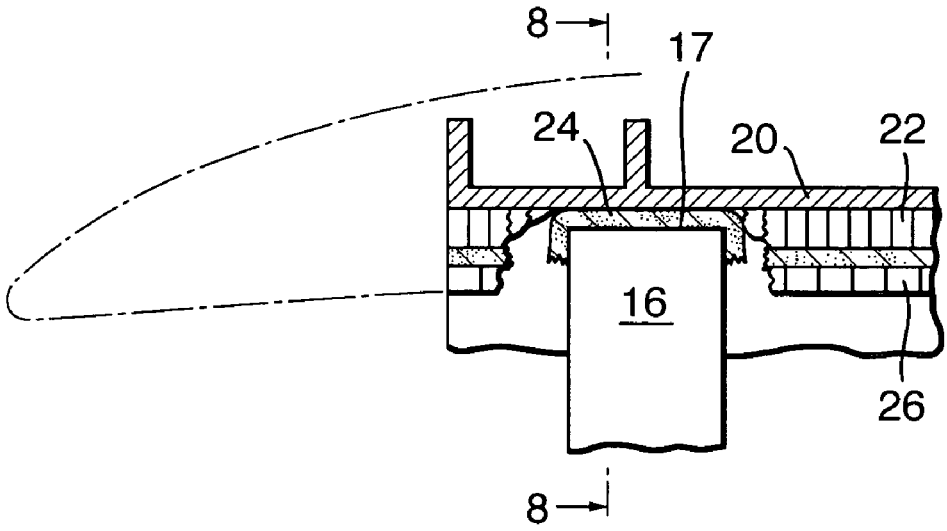
FIG. 7 is as FIG. 5 but with the fan blade displaced to a maximum.

Referring now to FIG. 7. Separated aerofoil part 16 has pushed composite layer 24 right through honeycomb structure 22 and into contact with casing 20. By this time however, aerofoil part 16 has lost sufficient energy imparted to it on separation, as to be contained by casing 20, without deformation of the latter.

Figure 8:
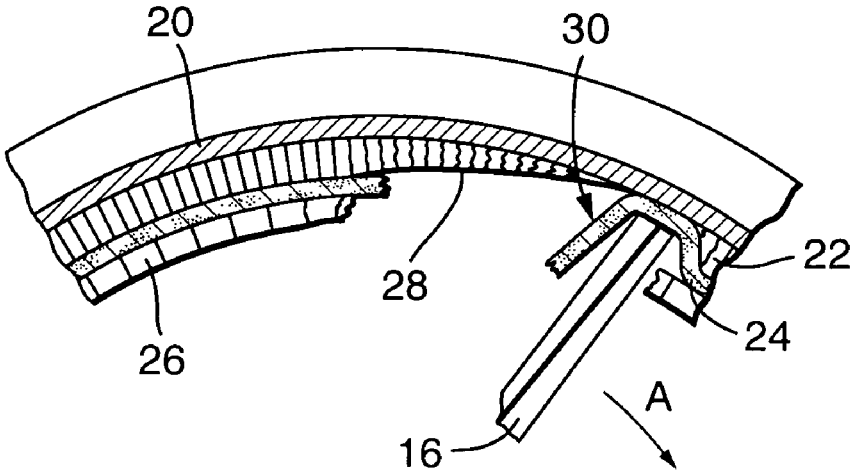
FIG. 8 is a view in the direction of arrows 8-8 in FIG. 7.

Referring now to FIG. 8. This view also depicts the situation reached in FIG. 7. At this point, separated aerofoil 16 part will be discharged from the fan duct 14 in a downstream direction.

The composite layer can be selected from glass fibre, carbon fibre, KEVLAR, or any other similar material. The composite material may be a combination of two or more of such fibres, arranged in layers and glued together by an appropriate adhesive so as to achieve the desired result i.e. to de-laminate locally so as to break across the width of the laminate in a direction axially of the structure, and closely behind the separated aerofoil, having regard to its peripheral direction of movement "A". The composite material is stronger in compression in a direction radially of the structure than in a direction peripherally, circumferentially of the structure.

Whilst the present invention has been described only in situ around a fan stage (not shown), the structure, without departing from the scope of the present invention, can be extended downstream of the fan stage so as to protect the downstream part of casing 20, against damage normally caused by aerofoil root parts (not shown) that have left the fan disk and moved downstream of the fan stage before striking the containment structure.

I claim:

1. A separated blade part containment structure, comprising:

an annular metallic casing having an inner surface; and an annular structure, the annular structure consisting of:

a first annular honeycomb layer bonded to the inner surface of the annular metallic casing;

a liner having an outer surface and an inner surface and comprising an annular layer of composite material, the outer surface of the liner being bonded to an inner surface of the first annular honeycomb layer, the annular layer of composite material having a configuration of being continuously formed and unbroken in an annular direction so as to be stronger in compression in a direction radially of the annular structure than in tension in a direction peripherally of the annular structure; and a second honeycomb structure, which is abradable, disposed on the inner surface of the liner, sandwiching the liner between the first honeycomb structure and the second honeycomb structure, wherein the configuration of the annular layer causes breaking of the liner across a width of the annular layer of composite material in a direction axially of the annular structure when the annular layer of composite material becomes trapped between a separated, moving blade part and the first honeycomb structure of the annular structure, to enable a free end portion of the liner to wrap around a liner contacting portion of the separated, moving blade part.

2. A separated blade part containment structure as claimed in claim 1, wherein said containment structure defines a fan duct of a ducted fan gas turbine engine.

3. A separated blade part containment structure as claimed in claim 1, wherein said composite material comprises glass fibres.

4. A separated blade part containment structure as claimed in claim 1, wherein said composite material comprises carbon fibres.

5. A separated blade part containment structure as claimed in claim 1, wherein said composite material comprises KEVLAR.

6. A separated blade part containment structure as claimed in claim 1, wherein said composite material comprises a combination of glass fibres and carbon fibres.

7. A separated blade part containment structure as claimed in claim 1, wherein said composite material comprises a combination of glass fibres and KEVLAR.

8. A separated blade part containment structure as claimed in claim 1, wherein said composite material comprises a combination of carbon fibres and KEVLAR.

9. A ducted fan gas turbine engine, comprising:

a ducted fan arranged in a fan duct; and a structure defined by said fan duct, the said structure forming a separated blade part containment structure, the separated blade part containment structure comprising:

a casing;

a first annular honeycomb structure;

a continuous and unbroken annular layer of composite material; and a second annular honeycomb structure;

wherein the first annular honeycomb structure is bonded to an inner surface of the casing, the annular layer of composite material is bonded to an inner surface of the first annular honeycomb structure, the second annular honeycomb structure is disposed on an inner surface of the annular layer of composite material sandwiching the annular layer of composite material between the first annular honeycomb structure and the second annular honeycomb structure, and the annular layer of composite material is stronger in compression in a direction radially of the separated blade part containment structure than in tension in a direction peripherally of the separated blade part containment structure.

* * * * *